US008642242B2

(12) United States Patent
Hiraoka et al.

(10) Patent No.: US 8,642,242 B2
(45) Date of Patent: Feb. 4, 2014

(54) ELECTROSTATIC CHARGE IMAGE DEVELOPING TONER AND METHOD OF MANUFACTURING THE SAME

(75) Inventors: Saburou Hiraoka, Tokyo (JP); Mikihiko Sukeno, Hyogo (JP); Hajime Tadokoro, Kanagawa (JP); Ken Ohmura, Tokyo (JP); Tatsuya Nagase, Tokyo (JP); Tomomi Oshiba, Tokyo (JP); Kenji Hayashi, Tokyo (JP); Tomoko Mine, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 167 days.

(21) Appl. No.: 13/281,935

(22) Filed: Oct. 26, 2011

(65) Prior Publication Data

US 2012/0107741 A1 May 3, 2012

(30) Foreign Application Priority Data

Nov. 1, 2010 (JP) ..... 2010-244897

(51) Int. Cl.
*G03G 9/087* (2006.01)

(52) U.S. Cl.
USPC ..... 430/137.11; 430/137.14; 430/110.2

(58) Field of Classification Search
USPC ..... 430/137.11, 137.14
See application file for complete search history.

(56) References Cited

U.S. PATENT DOCUMENTS

| | | | | |
|---|---|---|---|---|
| 5,290,654 | A * | 3/1994 | Sacripante et al. | 430/137.14 |
| 2009/0142689 | A1* | 6/2009 | Sacripante et al. | 430/137.14 |
| 2010/0055595 | A1* | 3/2010 | Shirai et al. | 430/137.14 |
| 2011/0207044 | A1* | 8/2011 | Zwartz et al. | 430/137.14 |
| 2012/0107740 | A1* | 5/2012 | Jugle et al. | 430/137.11 |

FOREIGN PATENT DOCUMENTS

| | | |
|---|---|---|
| JP | 2008-256913 | 10/2008 |
| JP | 2008-262166 | 10/2008 |
| JP | 2009-223281 | 10/2009 |
| JP | 2010-055092 | 3/2010 |

* cited by examiner

*Primary Examiner* — Christopher Rodee
(74) *Attorney, Agent, or Firm* — Lucas & Mercanti, LLP

(57) ABSTRACT

Provided is a method of manufacturing toner by which the toner capable of forming high quality images and reproducing high density gradation, which exhibits an excellent high-temperature offsetting property together with excellent low-temperature fixability, and provides appropriate gloss with respect to images to be formed, can be stably prepared; and also provided is the toner. After conducting a step in which particles made of at least a crystalline polyester resin are coagulated to form core coagulated particles, and an unsaturated amorphous polyester resin particle is attached onto the surface of each of the core coagulated particles to form core-shell type coagulated particles, radical polymerization reaction is conducted by acting a radical polymerization initiator on the foregoing core-shell type coagulated particles to conduct a step in which a layer made of a crosslinking amorphous polyester resin is formed on the surface of each of the core coagulated particles.

9 Claims, No Drawings

ELECTROSTATIC CHARGE IMAGE DEVELOPING TONER AND METHOD OF MANUFACTURING THE SAME

This application claims priority from Japanese Patent Application No. 2010-244897 filed on Nov. 1, 2010, which is incorporated hereinto by reference.

TECHNICAL FIELD

The present invention relates to an electrostatic charge image developing toner (hereinafter, also referred to simply as "toner"), and to a method of manufacturing the same.

BACKGROUND

In recent years, as to an electrophotographic image forming apparatus, an energy saving system has been demanded from the viewpoint of environmental consciousness with respect to the global environment. Improvement for a fixing system in an image forming apparatus, in which a great deal of energy is consumed, has been daily in progress, and low-temperature fixability with respect to toner has been highly demanded in order to realize energy saving in the fixing system. It is an effective means to realize low-temperature fixability that a polyester resin capable of changing a rapid fusing characteristic caused by raised temperature is utilized as a binder for the toner, but there may often appear a trouble such that it is difficult to obtain high-temperature offsetting resistance from a cause of an excellent fusing characteristic at high temperature; the resulting image has exhibited excessive gloss; and so forth.

In order to solve such a problem, proposed is a method of using a polyester resin having a crosslinking structure by which a large drop in elasticity at high temperature is inhibited (refer to Patent Document 1, for example).

However, a method of manufacturing toner disclosed in Patent Document 1 relates to a pulverization method, and in the case of the pulverization method, a great deal of energy is to be consumed in order to toner having a small particle diameter. Further, since downsizing of the toner particle diameter is limited, in recent years, often produced has been difficulty in high image-quality imaging as another attentive quality item which is desired for an electrophotographic image forming apparatus. On the other hand, in order to prepare toner having a small diameter, it is commonly known that it is effective to utilize a polymerization method in place of a pulverization method. The pulverization method is a collective term for a method of manufacturing toner via a chemical technique under a wet process condition (in water, an aqueous medium or an organic solvent). It appears that the toner is prepared with a polyester resin having a crosslinking structure via a polymerization method as a means of making low-temperature fixability and high-temperature offsetting resistance to be compatible, and of making inhibition of excessive gloss of the resulting image and achievement in high image-quality caused by downsizing of the toner particle diameter to be compatible, but in the case of a polymerization method, concerning inclusion of a step of finely dispersing a polyester resin, the polyester resin having a crosslinking structure can not be finely dispersed, or it is very difficult to make the foregoing performance items to be compatible at present since a large amount of energy is to be consumed.

In order to solve the above-described problem, for example, in Patent Documents 2 and 3, disclosed is a manufacturing method by which a crosslinking structure is formed during granulation of toner particles via a polymerization method by using a polyester resin into which an isocyanate group is introduced.

However, in the case of such a manufacturing method of toner, since the isocyanate group exhibits extremely high reactivity in its process, there appears a problem such that reaction is difficult to be controlled, whereby manufacturing can not be conducted stably.

Further, as a method of manufacturing toner containing a polyester resin having a crosslinking structure via a polymerization method, disclosed is a method of manufacturing toner having a core-shell structure in which a core particle composed of a crystalline polyester particle and a polyester resin particle containing at least a polymerizable unsaturated bond is prepared; a core-shell type coagulated particle is further prepared by attaching a polyester resin particle containing at least a polymerizable unsaturated bond onto the circumferential surface of the core particle; and the polymerizable unsaturated bond is subjected to radical polymerization via action of a radical polymerization initiator on this core-shell type coagulated particle to form a crosslinking structure.

This manufacturing method makes it possible to prepare the toner containing a polyester resin having a crosslinking structure via a polymerization method, and makes low-temperature fixability and high-temperature offsetting resistance to be compatible and makes inhibition of excessive gloss of the resulting image and achievement in high image-quality caused by downsizing of the toner particle diameter to be compatible, but on the other hand, depending on timing acting on radical polymerization initiator in a manufacturing method, there often appears a preparation trouble such that an aggregate of polyester resin particle-to-polyester resin particle each particle containing at least a polymerizable unsaturated bond is formed; the radical polymerization initiator is acted on this; a crosslinking body of this is formed; and so forth, resulting in lowering of manufacturing yield. Further, since a particle size distribution of prepared toner is broadened, often produced is a problem such that naturalness of density gradation in the resulting images originated by unevenness in electrification characteristic is deteriorated, and so forth.

Patent Document 1: Japanese Patent O.P.I. (Open to Public Inspection) Publication No. 2009-223281

Patent Document 2: Japanese Patent O.P.I. (Open to Public Inspection) Publication No. 2008-262166

Patent Document 3: Japanese Patent O.P.I. (Open to Public Inspection) Publication No. 2008-256913

Patent Document 4: Japanese Patent O.P.I. (Open to Public Inspection) Publication No. 2010-55092

SUMMARY

The present invention has been made on the basis of the above-described situation, and it is an object of the present invention to provide a method of manufacturing an electrostatic charge image developing toner by which toner capable of basically forming high quality images and reproducing high density gradation, which exhibits an excellent high-temperature offsetting property together with excellent low-temperature fixability, and provides appropriate gloss with respect to the resulting images, can be prepared; and to provide the electrostatic charge image developing toner obtained by the foregoing method.

DESCRIPTION OF THE PREFERRED EMBODIMENTS

In the present invention, disclosed is a method of manufacturing an electrostatic charge image developing toner comprising a toner particle containing a binder resin comprising an amorphous polyester resin having a crosslinking structure and a crystalline polyester resin, comprising the steps of (a-1) preparing an aqueous medium dispersion of particles each made of the crystalline polyester resin, (a-2) preparing another aqueous medium dispersion of other particles each made of the amorphous polyester resin comprising a polymerizable unsaturated bond, (b) coagulating at least the particles in an aqueous medium to form core coagulated particles, (c) attaching each of the other particles onto a surface of each of the core coagulated particles to form core-shell type coagulated particles, and (d) subsequently conducting radical polymerization reaction via action of a radical polymerization initiator on the core-shell type coagulated particles to form a layer made of the amorphous polyester resin having the crosslinking structure on the surface of each of the core coagulated particles.

In the present invention, preferably disclosed is the method of Claim 1, further comprising the step of (e) adding a coagulation-termination agent into a reaction system in which each of the other particles each is attached onto each of the core coagulated particles between the steps (c) and (d).

It is a feature that a toner of the present invention is obtained by the above-described method.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Next, the present invention will be specifically described.

[Method of Manufacturing Toner]

In the present invention, disclosed is a method of manufacturing an electrostatic charge image developing toner comprising a toner particle containing a binder resin comprising an amorphous polyester resin having a crosslinking structure and a crystalline polyester resin, comprising the steps of (a-1) preparing an aqueous medium dispersion of particles each made of the crystalline polyester resin, (a-2) preparing another aqueous medium dispersion of other particles each made of the amorphous polyester resin comprising a polymerizable unsaturated bond, (b) coagulating at least the particles each made of the crystalline polyester resin in an aqueous medium to form core coagulated particles, (c) attaching each of the other particles each made of the amorphous polyester resin comprising a polymerizable unsaturated bond onto each of the core coagulated particles to form core-shell type coagulated particles, and (d) subsequently conducting radical polymerization reaction via action of a radical polymerization initiator on the core-shell type coagulated particles to form a layer made of the amorphous polyester resin having the crosslinking structure on a surface of each of the core coagulated particles.

The First Embodiment

Such a method of manufacturing toner as a specific example can possess the following steps.

(1-A-1) step of preparing a crystalline polyester resin particle dispersion in which a crystalline polyester resin is synthesized, and a dispersion of crystalline polyester resin particles each made of the crystalline polyester resin is prepared;

(1-B-1) step of preparing an amorphous polyester resin particle dispersion in which an amorphous polyester resin is synthesized, and a dispersion of particles each made of the amorphous polyester resin (hereinafter, referred to also as "amorphous polyester resin particles") is prepared;

(1-B-2) step of preparing an unsaturated amorphous polyester resin particle dispersion in which an unsaturated amorphous polyester resin is synthesized, and a dispersion of unsaturated amorphous polyester resin particles each made of the unsaturated amorphous polyester resin is Prepared;

(1-C) step of preparing a colorant particle dispersion in which a dispersion of particles each made of a colorant (hereinafter, referred to also as "colorant particles") is prepared, if desired;

(2) step of coagulation in which particles for toner constituent components such as resin particles each made of a binder resin material as crystalline polyester resin particles and amorphous polyester resin particles or the like, if desired, colorant particles, particles each made of a releasing agent, particles each made of a charge control agent and so forth are coagulated in an aqueous medium to form core coagulated particles;

(3) step of adhesion in which each of the unsaturated amorphous polyester resin particles is attached onto the surface of each of the core coagulated particles to form core-shell type coagulated particles;

(4) step of coagulation-termination in which attaching each of the unsaturated amorphous polyester resin particles onto the surface of each of the core coagulated particles is terminated to acquire desired core-shell type coagulated particles;

(5) step of fusion in which the resulting core-shell type coagulated particles are fused to form uncrosslinked core-shell type coagulated particles;

(6) step of crosslinkage in which radical polymerization reaction is conducted via action of a radical polymerization initiator on the uncrosslinked core-shell type coagulated particles to form a shell layer made of a crosslinking amorphous polyester resin;

(7) step of filtration•washing in which the resulting toner particles are filtrated from the aqueous medium to remove a surfactant or the like from the toner particles via a washing treatment;

(8) step of drying the toner particles having been subjected to the washing treatment; and (9) step of adding external additives in which external additives are added into the toner particles have been subjected to a drying treatment, if desired.

(1-A-1) Step of Preparing Crystalline Polyester Resin Particle Dispersion

This step of preparing a crystalline polyester resin particle dispersion is a step in which a crystalline polyester resin as a material for a binder resin constituting toner particles is synthesized, and this crystalline polyester resin is dispersed in the form of particles in an aqueous medium to prepare a dispersion of crystalline polyester resin particles. In the present invention, the crystalline polyester resin is a polyester resin exhibiting no change in stepwise endothermic quantity but a clear endothermic peak in accordance with a differential scanning calorimetry method (DSC). The crystalline polyester resin is not specifically limited, as long as it is such a crystalline polyester resin, and for example, if this resin as a resin having a structure in which a main chain formed of a crystalline polyester resin is copolymerized with another component is one exhibiting a clear endothermic peak as described above, the resin corresponds to crystalline polyester of the present invention.

A crystalline polyester resin used in the present invention preferably has a melting point of 30-99° C., and more preferably has a melting point of 45-88° C. The melting point of the crystalline polyester resin exhibits a peak top temperature at the maximum endothermic peak, and is measured via differential calorimetric analysis employing a differential calorimeter "DSC-7", manufactured by Perkin Elmer Corp. and a thermal analyzer controller "TAC7/DX", manufactured by Perkin Elmer Corp. Specifically, 0.5 mg of the crystalline polyester resin are sealed in an aluminum pan (KIT NO. 0219-0041) to be placed in a sample holder for "DSC-7", and temperature control of heat-cool-heat is conducted under the measurement conditions such as a measurement temperature of 0-200° C., a temperature rising rate of 10° C./min, and a temperature lowering rate of 10° C./min to conduct analysis based on data during the 2nd heating, provided that an empty aluminum pan has been used for the reference measurement.

This crystalline polyester resin preferably has a number average molecular weight (Mn) of 100-10,000 and more preferably has a number average molecular weight (Mn) of 800-5,000, and preferably has a weight average molecular weight (Mw) of 1,000-50,000 and more preferably has a weight average molecular weight (Mw) of 2,000-30,000, which are obtained via gel permeation chromatography of a tetrahydrofuran (THF) soluble component. When a weight average molecular weight (Mw) of the THF soluble component in the crystalline polyester resin is less than 1000, the resulting toner particles as a whole have exhibited a low melting point by compatibilizing it with an amorphous polyester resin in the after-mentioned fusing step, whereby blocking resistance tends to be degraded. Further, when the weight average molecular weight exceeds 50,000, the resulting toner tends to exhibit inferior low-temperature fixability.

Molecular weight measured via GPC is described below. That is, employed are "HLC-8220" (produced by TOSOH Corp.) and a column "TSKguardcolumn+TSKgelSuper HZM-M 3Ren" (produced by TOSOH Corp.). Tetrahydrofuran (THF) as a carrier solvent is allowed to flow at a flow rate of 0.2 ml/min while maintaining the column temperature at 40° C., and a measurement sample (crystalline polyester resin) is dissolved in tetrahydrofuran at room temperature under the dissolution condition to conduct a treatment for 5 minutes employing an ultrasonic homogenizer so as to reach a concentration of 1 mg/ml. Next, a treatment is carried out employing a 0.2 μm pore size membrane filter to obtain a sample solution, and 10 μl of this sample solution is injected into a device with the above-described carrier solvent to conduct detection employing a refractive index detector (RI detector). The molecular weight distribution of the measurement sample is calculated from a calibration curve which has been measured by employing monodispersed standard polystyrene particles. As the standard polyethylene sample for calibration curve measurement, employed are those having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, produced by Pressure Chemical Co., and the calibration curve is prepared via measurements of roughly, at least 10 standard polystyrene samples. In addition, a refractive index detector was used as a detector.

The crystalline polyester resin can be prepared from a dicarboxylic acid component and a diol component.

As a dicarboxylic acid component, an aliphatic dicarboxylic acid component is preferably used, and an aromatic dicarboxylic acid may be used in combination. As the dicarboxylic acid component, those straight-chained are preferably used. The dicarboxylic acid component is not limited to one kind of that, but may be used as a mixture of at least two kinds of that.

Examples of aliphatic dicarboxylic acids include an oxalic acid, a malonic acid, a succinic acid, a glutaric acid, an adipic acid, a pimelic acid, a suberic acid, an azelaic acid, a sebacic acid, a 1,9-nonanedicarboxylic acid, a 1,10-decanedicarboxylic acid, a 1,11-undecanedicarboxylic acid, a 1,12-dodecanedicathoxylic acid, a 1,13-tridecanedicarboxylic acid, a 1,14-tetradecanedicarboxylic acid, a 1,16-hexadecanedicarboxylic acid, a 1,18-octadecanedicarboxylic acid and so forth; and a lower alkyl ester thereof and an acid anhydride thereof are also usable. Among the above-described aliphatic dicarboxylic acids, an adipic acid, a sebacic acid and a 1,10-decanedicarboxylic acid are preferably used in view of commercial availability.

Examples of the aromatic dicarboxylic acid usable as an aliphatic dicarboxylic acid include a terephthalic acid, an isophthalic acid, an o-phthalic acid, a t-butylisophthalic acid, 2,6-naphthalenedicarboxylic acid, 4,4'-biphenyldicarboxylic acid and so forth. Of these, a terephthalic acid, an isophthalic acid, a t-butylisophthalic acid are preferably used in view of commercial availability and ease of emulsification. When the total dicarboxylic acid component to form a crystalline polyester resin is set to 100 mol % as a constitution, a consumption amount of the aromatic dicarboxylic acid is preferably designed to be 20 mol % or less as a constitution; more preferably designed to be 10 mol % or less as a constitution; and still more preferably designed to be 5 mol % or less as a constitution. When a consumption amount of the aromatic dicarboxylic acid is designed to be 20 mol % or less as a constitution, crystallinity of a crystalline polyester resin can be acquired, whereby the resulting toner exhibits excellent low-temperature fixability, and not only finally formed images exhibit gloss but also degradation in image storage caused by drop in melting point is suppressed. Further, when oil droplets are formed with oil-phase liquid containing the crystalline polyester resin, a emulsification state can be surely obtained.

Further, as a diol component, aliphatic diol is preferably used, but diol other than aliphatic diol may be contained, if desired. As the diol component, among aliphatic diols, a straight-chained aliphatic diol having 2-22 carbon atoms constituting the main chain is preferably used, and thither, a straight-chained aliphatic diol having 2-22 carbon atoms constituting the main chain is more preferably used in view of commercial availability, generation of reliable low-temperature fixability, and obtainable images exhibiting high gloss. When the number of carbon atoms constituting the main chain of a straight-chained aliphatic diol to be used is 2-22, no formation of a polyester resin having a melting point at a level where low-temperature fixability also in cases where an aromatic dicarboxylic acid is used in combination as a dicarboxylic acid component; the resulting toner exhibits sufficient low-temperature fixability; and finally formed images also exhibit high gloss. As a diol component, branched aliphatic diol is usable, but in this case, it is used with straight-chained aliphatic diol, and is preferably used via increase of a ratio of the straight-chained aliphatic diol in view of acquisition of crystallinity. When using at a high ratio of the straight-chained aliphatic diol in such a manner, the resulting toner surely exhibits excellent low-temperature fixability via acquisition of crystallinity; as to finally formed images, degradation in image storage caused by drop in melting point is suppressed; and blocking resistance is also surely obtained. The diol component is not limited to one kind of that, but may be used as a mixture of at least two kinds of that.

A diol component to form a crystalline polyester resin preferably has an aliphatic diol content of 80 mol % or more as a constitution, and more preferably has an aliphatic diol content of 80 mol % or more as a constitution. When an aliphatic diol content in the diol component is 80 mol % or more as a constitution, crystallinity of a crystalline polyester resin can be acquired, whereby not only the resulting toner exhibits excellent low-temperature fixability, but also finally formed images exhibit gloss.

Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol and so forth, and of these, ethylene glycol, 1,4-butanediol, 1,6-hexanediol, 1,9-nonanediol, and 1,10-decanediol are preferably used.

Examples of diol other than aliphatic diol include diol having a double bond and diol having a sulfonic acid group, and specific examples of diol having a double bond include 2-butene-1,4-diol, 3-hexene-1,6-diol, 4-octene-1,8-diol and so forth. A content of diol having a double bond in a diol component is preferably 20 mol % or less as a constitution, and more preferably 2-10 mol % or less as a constitution. When a content of diol having a double bond is 20 mol % or less as a constitution, the resulting polyester resin does not become one exhibiting a largely reduced melting point, whereby filming tends not to be generated.

As to a consumption ratio of a diol component and a dicarboxylic acid component as described above, an equivalent ratio [OH]/[COOH] of hydroxyl group [OH] in the diol component to carboxyl group [COOH] in the dicarboxylic acid component is preferably set to 1.5/1-1/1.5, and more preferably 1.2/1-1/1.2.

When the used ratio of the polyol component and the polycarboxylic acid component falls within the above range, a polyester segment having a desired molecular weight can surely be obtained.

As a method of dispersing the above-described crystalline polyester resin in an aqueous medium, provided is a method by which the crystalline polyester resin is dissolved or dispersed in an organic solvent to prepare an oil-phase liquid; the oil-phase liquid is dispersed in an aqueous medium via phase-transfer emulsification; and oil-droplets which have been controlled to obtain the desired particle are formed to subsequently remove an organic solvent.

In the present invention, "aqueous medium" is referred to as a medium containing at least 50% by weight of water. As a component other than water, a water-soluble organic solvent is cited, and examples thereof include methanol, ethanol, isopropanol, butanol, acetone, methyl ethyl ketone, dimethylformamide, methyl cellosolve, tetrahydrofuran and so forth. Of these, preferably used are alcohol based organic solvents such as methanol, ethanol, isopropanol, and butanol as organic solvents dissolving no resin.

The consumption amount of aqueous medium is preferably 50-2,000 parts by weight, and more preferably 100-1,000 parts by weight, based on 100 parts by weight of oil-phase liquid. When the consumption amount of the aqueous medium falls within the above-described range, the oil-phase liquid can be emulsification-dispersed in an aqueous medium so as to reach the desired particle diameter.

A dispersion stabilizer may be dissolved in an aqueous medium, and further, a surfactant, resin particles or the like may be also added in the aqueous medium in order to improve dispersion stability of oil-droplets. As the dispersion stabilizer, cited is an inorganic compound such as tricalcium phosphate, calcium carbonate, titanium oxide, colloidal silica, hydroxyapatite or the like, but an acid- or alkali-soluble dispersion stabilizer such as tricalcium phosphate or the like is preferably used, since the dispersion stabilizer is to be removed from the resulting toner mother body particle. Further, those degradable with enzyme are preferably used in view of environmental aspect. Usable examples of surfactants include anionic surfactants such as an alkylbenzenesulfonic acid salt, an α-olefin sulfonic acid salt, a phosphoric acid ester and so forth; amine salt type cationic surfactants such as an alkylamine salt, an aminoalcohol fatty acid derivative, a polyamine fatty acid derivative, imidazoline and so forth, and quaternary ammonium salt type cationic surfactants such as an alkyltrimethylammonium salt, a dialkyldimethylammonium salt, an alkyldimethylbenzylammonium salt, a pyridinium salt, an alkylisoquinolinium salt, a benzethonium chloride and so forth; nonionic surfactants such as a fatty acid amide derivative, a polyhydric alcohol derivative and so forth; and amphoteric surfactants such as alanine, dodecyl-di-(aminoethyl)glycine, di(octylaminoethyl)glycine, N-alkyl-N,N-dimethylammonium betaine and so forth. Further, anionic or cationic surfactants each having a fluoroalky group are also usable. Resin particles to improve dispersion stability are preferably those having a particle diameter of 0.5-3 μm, and specific examples thereof include methyl polymetacrylate resin particles having a particle diameter of 1 μm or 3 μm, polystyrene resin particles having a particle diameter of 0.5 μm or 2 μm, polystyrene-acrylonitrile resin particles having a particle diameter of 1 μm, and so forth.

As an organic solvent used to prepare oil-phase liquid, from the viewpoint of an easy removal treatment after forming oil-droplets, preferable are those having a low boiling point and low solubility to water. Specific examples thereof include methyl acetate, ethyl acetate, methyl ethyl ketone, methyl isobutyl ketone, toluene, xylene and so forth. These can be used singly, or in combination with at least two kinds thereof. The consumption amount of the organic solvent is conventionally 1-300 parts by weight; preferably 1-100 parts by weight; and more preferably 25-70 parts by weight, based on 100 parts by weight of a crystalline polyester resin.

Emulsifying dispersion of the oil-phase liquid can be carried out utilizing mechanical energy. Homogenizers to conduct emulsifying dispersion are not specifically limited, and examples thereof include a low-speed shearing homogenizer, a high-speed shearing homogenizer, a friction type homogenizer, a high-pressure jet type homogenizer, an ultrasonic homogenizer and so forth. "TK Homomixer" produced by Tokushu Kika Kogyo Co., Ltd. or the like is exemplified as a specific example. The dispersion diameter of oil-droplets is preferably designed to be 60-1000 nm, and more preferably designed to be 80-500 nm. When the dispersion diameter of oil-droplets falls within the above-described range, the surface area of the oil-droplet, that is, the region where crosslinking reaction is produced becomes a desirably suitable area, whereby it becomes possible to make low-temperature fixability and offsetting resistance to be compatible at a high level. The dispersion diameter of oil-droplets is a volume-based median diameter measured employing a laser scattering particle size distribution analyzer "LA-750" manufactured by HORIBA, Ltd. The dispersion diameter of these oil-droplets can be controlled by an amount of mechanical energy during emulsifying dispersion.

Removal of an organic solvent after forming oil-droplets can be conducted via operation of desolvation after temperature of the entire dispersion in a state where toner particles are dispersed in an aqueous medium is gradually raised while stirring in a laminar flow, and stirring is rigorously conducted in a given temperature range. Further, when forming toner particles with a dispersion stabilizer, a removal treatment of the dispersion stabilizer is also conducted via addition and mixture of an acid or alkali after conducting a removal treatment of an organic solvent.

(1-B-1) Step of Preparing Amorphous Polyester Resin Particle Dispersion

This step of preparing an amorphous polyester resin particle dispersion is a step in which an amorphous polyester resin as a material for a binder resin constituting toner particles is synthesized, and this amorphous polyester resin is dispersed in the form of particles in an aqueous medium to prepare a dispersion of amorphous polyester resin particles. In the present invention, the amorphous polyester resin means polyester other than the above-described crystalline polyester resin, and one conventionally having no melting point and having considerably high glass transition point Tg.

The amorphous polyester resin can be synthesized similarly to a synthetic process of the above-described crystalline polyester resin by using a polyhydric alcohol component and a polycarboxylic acid component.

This amorphous polyester resin preferably has a glass transition point Tg of 20-90° C., and more preferably has a glass transition point Tg of 35-65° C. Further, this amorphous polyester resin preferably has a softening point of 80-220° C., and more preferably has a softening point of 80-150° C. Herein, glass transition point Tg of the amorphous polyester resin is determined using a differential scanning calorimeter "DSC-7" produced by Perkin Elmer, Inc. and thermal analysis controller "TAC7/DX" produced by Perkin Elmer, Inc. Specifically, 4.50 mg of the amorphous polyester resin is sealed in an aluminum pan "Kit No. 0219-0041", and placed in a "DSC-7" sample holder. An empty aluminum pan is used as the reference measurement. Determination is carried out under the conditions of a measuring temperature of 0-200° C., a temperature increasing rate of 10° C./minute, and a temperature decreasing rate of 10° C./minute via a heating-cooling-heating temperature control. Data are collected during the second heating. Glass transition point Tg is represented as the intersection of extension of the base line, prior to the initial rise of the first endothermic peak, with the tangent showing the maximum inclination between the initial rise of the first endothermic peak and the peak summit. In addition, temperature is kept at 200° C. for 5 minutes during temperature increase at the first heating. Further, the softening point is determined as follows: namely, first, 1.3 g of the amorphous polyester resin are placed in a petri dish at 20° C. and 50% RH, and evenly charged, being left standing for at least 12 hours. Thereafter, a molded sample of a 1 cm diameter columnar shape is prepared by applying a force of 3820 kg/cm$^2$ for 30 seconds using a molding machine "SSP-10A" produced by Shimadzu Corp. Next, using a flow tester "CFT-500D" produced by Shimadzu Corp. at 24° C. and 50% RH, this molded sample is extruded through columnar die orifice (1 mm diameter×1 mm) by use of a 1 cm diameter piston, from completion of preheating, under the conditions of a weight of 196 N (20 kgf), an initial temperature of 60° C., a preheating duration of 300 seconds, and a temperature increasing rate of 6° C./minute. An offset method temperature $T_{offset}$, determined at an offset value of 5 mm via a melt temperature measurement method employing a temperature increasing method, is designated as a softening point of the amorphous polyester resin.

This amorphous polyester resin preferably has a number average molecular weight Mn of 2,000-10,000 and more preferably has a number average molecular weight Mn of 2,500-8,000, determined via gel permeation chromatography for a THF soluble component, and the amorphous polyester resin preferably has a weight average molecular weight Mw of 3,000-100,000 and more preferably has a weight average molecular weight Mw of 4,000-70,000, determined via gel permeation chromatography for a THF soluble component. When a THF soluble component in the amorphous polyester resin has a weight average molecular weight Mw of less than 3,000, the resulting toner tends to exhibit inferior blocking resistance, and when the THF soluble component has a weight average molecular weight Mw exceeding 100,000, the resulting toner tends not to obtain low-temperature fixability. The GPC molecular weight measurement is carried out by the same method as in the molecular weight measurement of a crystalline polyester resin, except that a THF soluble component of the amorphous polyester resin is used as a measuring sample.

Examples of the polyhydric alcohol component used to form an amorphous polyester resin include bisphenols such as bisphenol A, bisphenol F and so forth, and alkylene oxide adducts of bisphenols such as ethylene oxide adducts thereof, propylene oxide adducts thereof and so forth. Further, examples of the polyhydric alcohol component having at least trivalent include glycerin, trimethylol propane, pentaerythritol, sorbitol and so forth in addition to the above-described aliphatic diols. Further, cyclohexanedimethanol and neopentyl alcohol and so forth are preferably used in view of manufacturing cost and environmental aspect. These can be used singly or in combination with at least 2 kinds thereof.

Examples of the polycarboxylic acid component to form an amorphous polyester resin include aromatic dicarboxylic acids such as a phthalic acid, an isophthalic acid, a terephthalic acid, a naphthalenedicarboxylic acid in addition to the above-described aliphatic dicarboxylic acids. In order to realize appropriate melt viscosity of the resulting amorphous polyester resin, a polycarboxylic acid having at least trivalent such as a trimellitic acid, a pyromellitic acid or the like may be used. These can be used singly or in combination with at least 2 kinds thereof.

In the synthesis of the amorphous polyester resin, as to the consumption ratio of the above-described alcohol component to the above-described polycarboxylic acid component, an equivalent ratio [OH]/[COOH] of a hydroxyl group [OH] in the polyhydric alcohol component to a carboxyl group [COOH] in the polycarboxylic acid component is preferably 1.5/1-1/1.5, and more preferably 1.2/1-1/1.2. When the consumption ratio of the polyhydric alcohol component to the polycarboxylic acid component falls within the above-described range, an amorphous polyester resin having a desired molecular weight can be surely obtained.

As a method of dispersing an amorphous polyester resin as described above in an aqueous medium, exemplified is a method by which similarly to the case where a crystalline polyester resin is dispersed in an aqueous medium, oil-phase liquid is prepared by dissolving or dispersing the amorphous polyester resin in an organic solvent; the oil-phase liquid is dispersed in an aqueous medium via phase-transfer emulsification of the oil-phase liquid to form oil-droplets controlled so as to obtain a desired particle diameter; and subsequently, the organic solvent is removed therefrom. The oil-droplets preferably have a dispersion diameter of 60-1000 nm, and more preferably have a dispersion diameter of 80-500 nm. The dispersion diameter of oil-droplets is a volume-based median diameter measured employing a laser scattering particle size distribution analyzer "LA-750" manufactured by HORIBA, Ltd. The dispersion diameter of these oil-droplets can be controlled by an amount of mechanical energy during emulsifying dispersion.

(1-B-1) Step of Preparing Amorphous Polyester Resin Particle Dispersion

This step of preparing an amorphous polyester resin particle dispersion is a step in which an unsaturated amorphous to obtain a cross-linking amorphous polyester resin as a material for a binder resin constituting toner particles is synthesized, and this unsaturated amorphous polyester resin is dispersed in the form of particles in an aqueous medium to prepare a dispersion of unsaturated amorphous polyester resin particles. In the present invention, the unsaturated amorphous polyester resin is one containing at least a polymerizable unsaturated bond radically polymerizable inside the molecular chain, and conventionally having no melting point but a considerably high glass transition point Tg, unlike the above-described crystalline polyester resin.

As to an unsaturated amorphous polyester resin, a polyhydric alcohol component and a polycarboxylic acid component wherein at least one of them contains a polymerizable unsaturated bond are usable to conduct synthesis similarly to a step of synthesizing the above-described crystalline polyester resin.

A polydiol and a polycarboxylic acid wherein at least one of them contains a polymerizable unsaturated bond means any combination in the following (1), (2) or (3);

(1) A part or all of a polyhydric alcohol component having a polymerizable unsaturated bond and a polycarboxylic acid component having no polymerizable unsaturated bond, (2) A polyhydric alcohol component having no polymerizable unsaturated bond and a part or all of a polycarboxylic acid component having a polymerizable unsaturated bond, and (3) A part or all of a polyhydric alcohol component having a polymerizable unsaturated bond and a part or all of a polycarboxylic acid component having a polymerizable unsaturated bond.

This unsaturated amorphous polyester resin preferably has a glass transition point Tg of 20-90° C., and more preferably has a glass transition point Tg of 35-65° C. Further, this amorphous polyester resin preferably has a softening point of 70-220° C., and more preferably has a softening point of 80-180° C. The glass transition point and the softening point of the unsaturated amorphous polyester resin are measured by the same method as in the case of the glass transition point and the softening point of the amorphous polyester resin, except that an unsaturated amorphous polyester resin is used as a measuring sample.

This unsaturated amorphous polyester resin preferably has a number average molecular weight Mn of 1,000-15,000 and more preferably has a number average molecular weight Mn of 1,500-10,000, determined via gel permeation chromatography for a THF soluble component, and the unsaturated amorphous polyester resin preferably has a weight average molecular weight Mw of 2,000-50,000 and more preferably has a weight average molecular weight Mw of 2,000-30,000, determined via gel permeation chromatography for a THF soluble component. The molecular weight is measured via GPC by the same method as in the case of measurement of the molecular weight of a crystalline polyester resin, except that a THF soluble component of an unsaturated amorphous polyester resin is used as a measuring sample.

As a polyhydric alcohol component usable for forming an unsaturated amorphous polyester resin, cited is a polyhydric alcohol component to synthesize an unsaturated amorphous polyester resin, and when a polymerizable unsaturated bond in an unsaturated amorphous polyester resin is introduced from a polyhydric alcohol component, examples of the polyhydric alcohol component usable for forming the unsaturated amorphous polyester resin include alkenediols or the like such as 2-butene-1,4-diol, 3-hexene-1,6-diol, 4-octene-1,8-diol and so forth each having a polymerizable unsaturated bond. These can be used singly, or in combination with at least two kinds thereof.

As a polycarboxylic acid component usable for forming an amorphous polyester resin, cited is a polycarboxylic acid component to synthesize an amorphous polyester resin, and when a polymerizable unsaturated bond in an unsaturated amorphous polyester resin is introduced from a polycarboxylic acid component, examples of the polycarboxylic acid component usable for forming the unsaturated amorphous polyester resin include polycarboxylic acid components each having a polymerizable unsaturated bond. Specific examples thereof include unsaturated aliphatic dicarboxylic acids such as a maleic acid, a fumaric acid, an itaconic acid, a citraconic acid, a glutaconic acid, an isododecenylsuccinic acid, an n-dodecenylsuccinic acid, an n-octenylsuccinic acid and so forth, an acid anhydride or an acid chloride thereof, and so forth. Further, a small amount of a monocarboxylic acid having a polymerizable unsaturated bond such as a cafferic acid or the like may be used in combination. These can be used singly, or in combination with at least two kinds thereof.

In the synthesis of the unsaturated amorphous polyester resin, as to the consumption ratio of the above-described alcohol component to the above-described polycarboxylic acid component, an equivalent ratio [OH]/[COOH] of a hydroxyl group [OH] in the polyhydric alcohol component to a carboxyl group [COOH] in the polycarboxylic acid component is preferably 1.5/1-1/1.5, and more preferably 1.2/1-1/1.2. When the consumption ratio of the polyhydric alcohol component to the polycarboxylic acid component falls within the above-described range, an unsaturated amorphous polyester resin having a desired molecular weight can be surely obtained.

As a method of dispersing an unsaturated amorphous polyester resin as described above in an aqueous medium, exemplified is a method by which similarly to the case where a crystalline polyester resin is dispersed in an aqueous medium, unsaturated amorphous polyester resin liquid is prepared by dissolving or dispersing the unsaturated amorphous polyester resin in an organic solvent; the unsaturated amorphous polyester resin liquid is dispersed in an aqueous medium via phase-transfer emulsification of this unsaturated amorphous polyester resin liquid to form oil-droplets controlled so as to obtain a desired particle diameter; and subsequently, the organic solvent is removed therefrom. The oil-droplets in a state of dispersion preferably have a volume-based median diameter of 50-400 nm, and more preferably have a volume-based median diameter of 80-200 nm (1-C) Step of Preparing Colorant Particle Dispersion This step of preparing a colorant particle dispersion is a step conducted, if desired, when one containing a colorant as a toner particle is desired to be obtained, the step in which the colorant is dispersed in the form of particles in an aqueous medium to prepare a dispersion of colorant particles.

[Colorant]

A commonly known dye or pigment is usable as a colorant. As colorants to obtain black toner, optionally usable are commonly known various kinds such as carbon black such as Furnace Black, Channel Black or the like, magnetic material such as magnetite, ferrite or the like, dye, inorganic pigment containing non-magnetic iron oxide, and so forth. Those commonly known such as dye, organic pigment and so forth are optionally usable as colorants to obtain color toner. Examples of organic pigments include C. I. Pigment Red 5, C. I. Pigment Red 48:1, C. I. Pigment Red 53:1, C. I. Pigment Red 57:1, C. I. Pigment Red 81:4, C. I. Pigment Red 122, C. I. Pigment Red 139, C. I. Pigment Red 144, C. I. Pigment Red 149, C. I. Pigment Red 166, C. I. Pigment Red 177, C. I. Pigment Red 178, C. I. Pigment Red 222, C. I. Pigment Red 238, C. I. Pigment Red 269, C. I. Pigment Yellow 14, C. I.

Pigment Yellow 17, C. I. Pigment Yellow 74, C. I. Pigment Yellow 93, C. Pigment Yellow 94, C. I. Pigment Yellow 138, C. I. Pigment Yellow 155, C. I. Pigment Yellow 180, C. I. Pigment Yellow 185, C. I. Pigment Orange 31, C. I. Pigment Orange 41, C. I. Pigment Blue 15:3, C. I. Pigment Blue 60, C. I. Pigment Blue 76 and so forth. Examples of dyes include C. I. Solvent Red 1, C. I. Solvent Red 49, C. I. Solvent Red 1, C. I. Solvent Red 1, C. I. Solvent Red 1, C. I. Solvent Red 1, C. I. Solvent Red 1, C. I. Solvent Red 52, C. I. Solvent Red 58, C. I. Solvent Red 68, C. I. Solvent Red 11, C. I. Solvent Red 122, C. I. Solvent Yellow 19, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 69, C. I. Solvent Blue 70, C. I. Solvent Blue 93, C. I. Solvent Blue 95 and so forth. The colorants to obtain toner for each color can be used singly, or in combination with at least two kinds thereof for each color.

Colorant dispersion can be made by utilizing mechanical energy. Colorant particles in a state of dispersion preferably has a volume-based median diameter of 10-300 nm; more preferably has a volume-based median diameter of 100-200 nm; and still more preferably has a volume-based median diameter of 100-150 nm. The volume-based median diameter of colorant particles is measured with an electrophoretic light scattering photometer ELS-800 (manufactured by Otsuka Electronics Co., Ltd.).

(2) Step of Coagulation

This step of coagulation is a step in which a crystalline polyester resin particle dispersion, and an amorphous polyester resin particle dispersion and/or an unsaturated amorphous polyester resin particle dispersion and/or a colorant particle dispersion and/or a releasing agent and a dispersion of other toner particle constituent components such as a charge control agent and so forth, if desired, are added and mixed; the coagulation is slowly carried out while balancing repulsive force on the particle surface via pH adjustment and coagulating force produced via addition of a coagulant made of an electrolyte material to conduct association while controlling an average particle diameter and a particle size distribution, and at the same time, shape control is carried out by conducting fusing of particle-to-particle while stirring with heat to form core coagulated particles containing at least crystalline polyester resin particles.

As surfactants, commonly known various surfactants are usable without any limitation, but usable examples of ionic surfactants include sulfonates (e.g., sodium dodecylbenzene sulfonate and sodium arylalkylpolyether sulfonate), sulfates (e.g., sodium dodecyl sulfate, sodium tetradecyl sulfate, sodium pentadecyl sulfate and sodium octyl sulfate), fatty acid salts (e.g., sodium oleate, sodium laurate, sodium caprate, sodium caprylate, sodium caproate, potassium stearate and calcium oleate) and so forth, and further, usable examples of nonionic surfactants include polyethylene oxide, polypropylene oxide, a combination of polypropylene oxide and polyethylene oxide, an ester of polyethylene glycol and a higher fatty acid, alkylphenol polyethylene oxide, an ester of polypropylene oxide and a higher fatty acid, sorbitan ester so forth. The above-described surfactants can be used singly, or in combination with at least two kinds thereof, if desired.

As a coagulant usable in this step of coagulation, for example, exemplified is monovalent, divalent or trivalent metal salt. Examples of metals constituting a coagulant include alkali metal such as lithium, potassium, sodium or the like; alkaline earth metal such as magnesium, calcium, strontium, barium or the like, and aluminum and so forth. Examples of counter-ions with respect to the foregoing metals (anion constituting a salt) include chloride ion, bromide ion, iodide ion, carbonate ion, sulfate ion and so forth.

A ratio of adding crystalline polyester resin particles into a reaction system in this step of coagulation is preferably adjusted in such a way that the crystalline polyester resin in the finally resulting toner particle has a content of 20-70% by weight. When the foregoing content is less than 20% by weight, the resulting toner tends to exhibit insufficient low-temperature fixability, and when the content exceeds 70% by weight, mechanical strength of the resulting toner tends to be deteriorated.

In the present invention, a resin to form a binder resin contained in core coagulated particles contains at least a crystalline polyester resin. An amorphous polyester resin and other resins may be further contained. An amorphous polyester resin to be contained may be one at least containing at least a polymerizable unsaturated bond; may be one containing no polymerizable unsaturated bond; and may also be both of them. Mechanical strength of the resulting toner is improved by containing an amorphous an amorphous polyester resin and an unsaturated amorphous polyester resin in core coagulated particles.

A ratio of adding at least one of the amorphous polyester resin particles and the unsaturated amorphous polyester resin particles into a reaction system is preferably adjusted in such a way that an amorphous polyester resin and an unsaturated amorphous polyester resin in the finally resulting toner particles have a total content of 10-60% by weight. When the foregoing content is less than 10% by weight, the resulting toner tends to exhibit insufficient mechanical strength, and when the content exceeds 60% by weight, the resulting toner tends to exhibit insufficient low-temperature fixability. Further, a relative ratio of adding crystalline polyester resin particles and a total amount of the amorphous polyester resin particles and the unsaturated amorphous polyester resin particles into a reaction system in this step of coagulation is preferably from 85:15 to 25:75 in weight ratio, and more preferably from 70:30 to 40:60 in weight ratio. When an amount of the crystalline polyester resin particles is excessive, the resulting toner tends to often exhibit inferior heat-resistant storage, and when an amount of the crystalline polyester resin particles is small, the resulting toner tends not to exhibit sufficient low-temperature fixability.

A ratio of adding colorant particles into a reaction system in this step of coagulation is preferably adjusted in such a way that the content in the finally resulting toner particles is 1-10% by weight, and more preferably adjusted in such a way that the content in the finally resulting toner particles is 2-8% by weight. When the colorant has a content of less than 1% by weight, desired coloration tends not to be obtained, and on the other hand, when the colorant has a content exceeding 10% by weight, liberated colorant and the colorant adhering to carrier are produced, resulting in influence to electrification.

When internal additives such as a releasing agent, a charge control agent and so forth are introduced into toner particles, a dispersion of internal additive particles each consisting of internal additives is prepared prior to (2) step of coagulation, and in (2) step of coagulation, a dispersion of the internal additive particles is mixed with a dispersion of crystalline polyester resin particles, a dispersion of amorphous polyester resin particles, a dispersion of unsaturated amorphous polyester resin particles and a dispersion of colorant particles. Further, for example, in (1-B-1) step of preparing an amorphous polyester resin particle dispersion or (1-B-2) step of preparing an unsaturated amorphous polyester resin particle dispersion, the foregoing internal additives are mixed in the inside of the amorphous polyester resin particles or the unsaturated amorphous polyester resin particles, and the resulting can be introduced into toner particles.

[Releasing Agent]

The releasing agent is not specifically limited, those commonly known are usable. Examples thereof include low molecular weight polyolefin such as polyethylene, polypropylene, polybutene or the like; synthesis ester wax, vegetable wax such as synthetic ester wax, carnauba wax, rice wax, candelilla wax, Japan tallow, jojoba oil or the like; mineral petroleum based wax such as montan wax, paraffin wax, microcrystalline wax, Fischer-Tropsch wax or the like; and modified substances thereof. The releasing agent conventionally has an addition amount of 0.5-25 parts by weight, based on 100 parts by weight of a binder resin in the finally resulting toner particles, and preferably has an addition amount of 3-15 parts by weight, based on 100 parts by weight of a binder resin in the finally resulting toner particles.

[Charge Control Agent]

Commonly known various compounds are usable for a charge control agent. The charge control agent has an addition amount of 0.1-10 parts by weight, based on 100 parts by weight of a binder resin in the finally resulting toner particles, and more preferably has an addition amount of 0.5-5 parts by weight, based on 100 parts by weight of a binder resin in the finally resulting toner particles.

Temperature in the reaction system in this step of coagulation, that is, coagulation temperature is preferably set to 10-35° C., and more preferably set to 20-30° C. When the coagulation temperature is set to fall within such a range, core coagulated particles can be stably formed, since an appropriate speed to form the core coagulated particles is acquired.

(3) Step of Adhesion

This step of adhesion is a step in which an unsaturated amorphous polyester resin particle is attached onto the surface of the resulting core particle, and a layer formed from the unsaturated amorphous polyester resin particle is coated onto the surface of the core coagulated particle to form a core-shell type coagulated particle; and specifically, the step is carried out by adding a dispersion unsaturated amorphous polyester resin particles in the presence of a coagulant into a reaction system in which the core coagulated particles are dispersed in an aqueous medium. In this step of adhesion, a coagulant may not be newly added, since as a coagulant, an added coagulant in the above-described (2) step of coagulation can be utilized as it is. Further, in order to adjust an adhesion speed of the unsaturated amorphous polyester resin particles, a coagulant can be also newly added. As a newly added coagulant, those described above are usable, and this newly added coagulant may be identical to the coagulant used in (2) step of coagulation described above, or may be different from the coagulant used in (2) step of coagulation described above.

A ratio of adding unsaturated amorphous polyester resin particles in this step of adhesion is preferably 2-20% by weight when a total amount of a polyester resin in the finally resulting toner particles is set to 100 parts by weight, and more preferably 5-10% by weight when a total amount of a polyester resin in the finally resulting toner particles is set to 100 parts by weight. When the addition ratio of the unsaturated amorphous polyester resin particles is within this range, the resulting toner easily acquires compatibility between low-temperature fixability and heat-resistant storage.

Temperature in the reaction system in this step of adhesion, that is, adhesion temperature is preferably set to 10-35° C., and more preferably set to 20-30° C. When the adhesion temperature is set to fall within such a range, the unsaturated amorphous polyester resin particle can be attached in high evenness onto the surface of the core coagulated particle.

(3) Step of Coagulation-Termination

This step of coagulation-termination is a step in which attaching the unsaturated amorphous polyester resin particle onto the surface of the core coagulated particle is terminated to obtain a core-shell type coagulated particle having desired composition and shape, and the step is carried out by adding a coagulation-termination agent made of a base compound capable of adjusting pH so as to get away from a pH environment where coagulating action of particles in (2) step of coagulation and (3) step of adhesion is accelerated. Examples of the coagulation-termination agent include ethylenediaminetetraacetic acid (EDTA) and its alkali metal salt such as a sodium salt, gluconal, sodium gluconate, potassium citrate, sodium citrate, a nitrotriacetate (NTA) salt, GLDA (commercially available L-glutamic acid N,N-diacetic acid), a humic acid, a fulvic acid, maltol, ethyl maltol, a pentaacetic acid, a tetraacetic acid, commonly known water soluble polymers each having a functional group of both a carboxyl group and a hydroxyl group (polymeric electrolyte), sodium hydroxide, potassium hydroxide and so forth. Of these, ethylenediaminetetraacetic acid (EDTA) and an alkali metal salt such as its sodium salt or the like are preferably used. Examples of the coagulation-termination agent (base component) include alkali metal salts such as an ethylenediamine tetraacetic acid (EDTA) and its sodium salt, gluconal, sodium gluconate, potassium citrate and sodium citrate, a nitrotriacetate (NTA) salt, GLDA (commercially available L-glutamic acid N,N-diacetic acid), a humic acid and a fulvic acid, maltol and ethylmaltol, a pentaacetic acid and a tetraacetic acid, commonly known water-soluble polymers having functional groups such as a carboxyl group and a hydroxyl group (polymeric electrolyte), sodium hydroxide, potassium hydroxide, and so forth. Of these, alkali metal salts such as an ethylenediamine tetraacetic acid (EDTA) and its sodium salt are preferably used.

(5) Step of Fusion

This step of fusion is a step in which after the above-described (4) step of coagulation-termination, unsaturated amorphous polyester resin particles, crystalline polyester resin particles and amorphous polyester resin particles which constitute core-shell type coagulated particles obtained in (4) step of coagulation-termination are fused by heating the reaction system to a fusing temperature to form uncrosslinked core-shell type coagulated particles.

The fusing temperature relating to this step of fusion is preferably a temperature not less than glass transition point Tg of an unsaturated amorphous polyester resin or an amorphous polyester resin, and not more than a melting point of a crystalline polyester resin. Further, a heating duration, that is, a fusing duration is preferably one hour or more; more preferably 1-10 hours; and still more preferably 2-5 hours. Toner particles obtained via fusion at the above-described fusion temperature and fusing duration tend to become those in which compatibility between low-temperature fixability and heat-resistant storage is acquired.

(6) Step of Crosslinkage

This step of crosslinkage is a step in which a polymerizable unsaturated bond in an unsaturated amorphous polyester resin present in an uncrosslinked core-shell type toner particles obtained through (5) step of fusion is radically polymerization-reacted to form a crosslinking structure in toner particles, and specifically, a crosslinking structure is formed in the unsaturated amorphous polyester resin present on the surface layer of each of uncrosslinked core-shell type toner particles to form a shell layer. This step can form an amorphous polyester resin having a crosslinking structure from which high elasticity is formed in toner particles, whereby mechanical strength of toner is improved, and the resulting images exhibit suppressed excessive gloss, together with acquisition of high-temperature offsetting resistance during formation of images.

As the radical polymerization initiator usable in this crosslinking step, those commonly known can be used, as long as they are water-soluble polymerization initiators, and examples thereof include water-soluble azo initiators such as 2,2'-azobis[2-(2-imidazoline-2-yl)propane]dihydrochloride, 2,2'-azobis[2-(2-imidazoline-2-yl)propane]disulfate anhydride, 2,2'-azobis(2-methylpropionamidine) dihydrochloride, 2,2'-azobis[N-(2-carboxyethyl)-2-methylpropionamidine]hydrate, 2,2'-azobis{2-[1-(2-hydroxyethyl)-2-imidazoline-2-yl]propane}dihydrochloride, 2,2'-azobis[2-(2-imidazoline-2-yl) propane], 2,2'-azobis(1-imino-1-pyrrolidino-2-ethylpropane)dihydrochloride, 2,2'-azobis{2-methyl-N-[1,1-bis(hydroxymethyl)-2-hydroxyethyl] propionamide, 2,2'-azobis[2-methyl-N-(2-hydroxyethyl) propionamide] and so forth; persulfates such as potassium persulfate, ammonium persulfate and so forth; and water-soluble polymerization initiators such as azobisaminodipropane acetate, azobiscyanovaleric acid and its salt, hydrogen peroxide and so forth. These can be used singly, or in combination with at least two kinds.

A radial polymerization initiator added into a reaction system preferably has an addition amount of 1-20% by weight when a total amount of unsaturated amorphous polyester resin particles used for constituting toner particles is set to 100% by weight, and more preferably has an addition amount of 5-15% by weight when a total amount of unsaturated amorphous polyester resin particles used for constituting toner particles is set to 100% by weight. When the addition amount of a radical polymerization initiator added into a reaction system is within the above-described range, generation of undesired particles is inhibited in the reaction system, whereby high manufacturing yield is obtained.

A crosslinking temperature relating to formation of a crosslinking structure in a step of crosslinkage is preferably not less than a degradation temperature of a radical polymerization initiator to be used, and not more than a melting temperature of a crystalline polyester resin. Further, a crosslinking duration relating to formation of a crosslinking structure in the step of crosslinkage is preferably not less than one hour; more preferably 1-10 hours; and still more preferably 2-5 hours. Toner particles obtained via crosslinkage in such a crosslinking temperature and crosslinking duration easily become those in which compatibility between low-temperature fixability and heat-resistant storage is acquired.

(7) Step of Filtration•Washing

In this step of filtration•washing, there are carried out a filtration treatment in which a dispersion of toner particles is cooled and toner particles are filtered and separated via solid-liquid separation of the toner particles from this dispersion of toner particles; and a washing treatment to remove an adhesion material such as a surfactant or the like from the separately filtered toner particles (cumulated material in the form of a cake). Specific methods of solid-liquid separation and washing include a centrifugal separation method, a filtration method under reduced pressure using a Buchner funnel, a filtration method using a filter press, and so forth. However, these are not specifically limited.

(8) Step of Drying

In this step of drying, washed toner particles are subjected to drying. Driers used in this step include a spray drier, a vacuum freeze drier, a vacuum drier, a stationary tray drier, a transportable tray drier, a fluid layer drier, a rotary type drier, and a stirring type drier. However, these are not specifically limited. Herein, toner particles having been subjected to a drying treatment preferably has a water content of 5% by weight or less, and more preferably has a water content of 2% by weight or less.

Herein, a water content in toner particles is determined via Karl-Fischer titration water determination. Specifically, automatic thermal vaporization moisture measuring system "AQS-724" (produced by Hiranuma Sangyo Co., Ltd.) equipped with an aquameter "AO-6", "AQI-601" (an interface for AQ-6), and a thermal vaporization apparatus "LE-24S" is used. After standing for 24 hours at 20° C. and 50% RH, 0.5 g of toner particles, precisely weighed, are placed in a 20 ml glass sample tube and the tube is tightly sealed employing a silicone rubber packing coated with TEFLON® to determine the moisture content present in this sealed ambience via measuring conditions and reagents described below. Further, to calibrate the water content present in the sealed ambience, two empty sample tubes are measured simultaneously.

Sample heating temperature: 110° C.

Sample heating duration: 1 min

Nitrogen gas flow rate: 150 ml/min

Reagents: Counter electrode liquid (cathode liquid): HYDRANAL COULOMAT CG-K (HYDRANAL (R)—Coulomat CG-K); generation liquid (anode liquid): HYDRANAL COULOMAT AK (HYDRANAL (R)—Coulomat AK)

Further, when toner particles having been subjected to a drying treatment are coagulated to each other via weak interparticle attractive force to form an aggregate, the aggregates may be pulverized. Herein, mechanical pulverizers such as a jet mill, a HENSCHEL mixer, a coffee mill, or a food processor may be used as a pulverizing machine.

(9) Step of Adding External Additives

The step of adding external additives is a step in which particle-shaped external additives such as particles made of a charge control agent, various inorganic and organic particles, particles made of a lubricant and so forth in order to adjust fluidity and electrification, and to improve a cleaning property for toner particles having been subjected to a drying treatment. As particles usable for external additives, preferable are inorganic oxide particles made of silica, titania, alumina or the like, and further, these inorganic particles have been preferably subjected to a hydrophobization treatment with a silane coupling agent, a titanium coupling agent or the like. This external toner in the toner has an addition amount of 0.1-5.0% by weight, and preferably has an addition amount of 0.5-4.0% by weight. Further, the external additives may be used in combination with various kinds.

The Second Embodiment

Further, as another specific example of a method of manufacturing toner of the present invention, the same method as in the first embodiment is also usable, except that (5) step of fusion and (6) step of crosslinkage in the first embodiment are conducted in reverse order. Specifically, as described above, a radical polymerization initiator is added into each of core-shell type coagulated particles prepared via (1-A-1) step of preparing a crystalline polyester resin particle dispersion, (1-B-1) step of preparing an amorphous polyester resin particle dispersion, (1-B-2) step of preparing an unsaturated amorphous polyester resin particle dispersion, (1-C) step of preparing a colorant particle dispersion, (2) step of coagulation, (3) step of adhesion and (4) step of coagulation-termination in a reaction system under the condition where no fusion is accelerated and the condition where radically polymerizable reaction of polymerizable unsaturated bonds produced by unsaturated amorphous polyester resin particles is accelerated to conduct the step of crosslinkage. Subsequently, toner particles in which a colorant, a releasing agent, a charge control agent and so forth are contained in a binder resin containing a crosslinking amorphous polyester resin, a crystalline polyester resin and an amorphous polyester resin can be prepared by fusing core-shell type coagulated particles each in which a crosslinking structure is formed.

The Third Embodiment

Further, as another specific different example of a method of manufacturing toner of the present invention, the same method as in the first embodiment is also usable, except that (5) step of fusion and (6) step of crosslinkage in the first embodiment are conducted at the same time. Specifically, as described above, a radical polymerization initiator is added into each of core-shell type coagulated particles prepared via (1-A-1) step of preparing a crystalline polyester resin particle dispersion, (1-B-1) step of preparing an amorphous polyester resin particle dispersion, (1-B-2) step of preparing an unsaturated amorphous polyester resin particle dispersion, (1-C) step of preparing a colorant particle dispersion, (2) step of coagulation, (3) step of adhesion and (4) step of coagulation-termination in a reaction system under the condition where fusion is accelerated and the condition where radically polymerizable reaction of polymerizable unsaturated bonds produced by unsaturated amorphous polyester resin particles is accelerated to conduct (5) step of fusion and (6) step of crosslinkage at the same time. Subsequently, toner particles in which a colorant, a releasing agent, a charge control agent and so forth, if desired, are contained in a binder resin containing a crosslinking amorphous polyester resin, a crystalline polyester resin and an amorphous polyester resin can be prepared.

Since a crosslinking structure is formed after having attached a particle made of an amorphous polyester resin containing at least a polymerizable unsaturated bond onto the surface of each of core coagulated particles in an aqueous medium as in a desired state in a method of manufacturing the above-described toner, polymerization toner containing a polyester resin having a crosslinking structure can be surely prepared, and the resulting toner becomes one in which toner particles having a desired composition and structure exhibit high yield, that is, one inhibiting a sharp particle size distribution. As a result, it exhibits excellent high-temperature offsetting resistance and heat-resistant storage produced by a polyester resin having a crosslinking structure formed in a toner particle, together with excellent low-temperature fixability, and appropriate gloss can be provided to the resulting images, and further, the toner capable of obtaining reproducibility of high density gradation can be manufactured in small consumption of energy in consequence of an excellent electrification property caused by a sharp particle size distribution.

The reason why the toner particle having a desired composition and structure can be obtained at high yield by forming a crosslinking structure after having attached a particle made of an amorphous polyester resin containing at least a polymerizable unsaturated bond onto the surface of each of core coagulated particles is as follows. That is, since there appears a state where formation of an aggregate of particle-to-particle, each particle made of an amorphous polyester resin containing at least a polymerizable unsaturated bond is suppressed during action of a radical polymerization initiator, it would appear that formation of a crosslinking material of the foregoing aggregate is suppressed in an aqueous medium after radical polymerization reaction.

[Toner]

The toner of the present invention is obtained by a manufacturing method as described above, and is made from a toner particle containing a binder resin containing at least a crosslinking amorphous polyester resin and a crystalline polyester resin.

[Particle Diameter of Toner Particle]

As to the toner obtained by a manufacturing method as described above, the toner particles preferably have a volume-based median diameter of 3-8 μm in view of improved transferability, improved image quality and low-temperature fixability. The toner particle size distribution preferably has a CV value of 0-25%, and more preferably has a CV value of 5-20%. When the CV value is within this range, evenness of electrification of the toner becomes high, and the resulting images exhibit reproducibility of density gradation. The CV value is determined by following Equation (x), wherein the arithmetic average particle diameter means the mean value of the volume-based particle diameter x with respect to 25,000 toner particles, and is determined employing "Coulter Multisizer III" (manufactured by Beckman Coulter, Inc.).

$$CV\text{ value}=\{(\text{standard deviation})/(\text{arithmetic average particle diameter})\}\times 100 \qquad \text{Equation (x):}$$

The volume-based median particle diameter and arithmetic average particle diameter of the toner are measured by "Coulter Multisizer III" (manufactured by Beckman Coulter, Inc.). Specifically, 0.02 g of the toner are added in 20 ml of a surfactant solution (a surfactant solution obtained by diluting a neutral detergent containing a surfactant component with deionized water to disperse the toner), followed by being wetted and then subjected to ultrasonically dispersing for one minute to prepare a toner dispersion. This toner dispersion is injected into a beaker in which an electrolyte solution "ISOTON II" (produced by Beckman Coulter, Inc.) is charged, which is placed on a sample stand, with a pipette, until the concentration indicated by the measuring apparatus reaches 5-10%. Herein, this concentration range makes it possible to obtain highly reproducible measurement values. Using the measuring apparatus, under conditions of the measured particle count number of 25,000 and an aperture diameter of 50 μm, the frequency is calculated by dividing a measurement range of 1-30 μm into 256 parts, and the particle diameter at a point of 50% from the larger one of the volume accumulation ratio (volume $D_{50}$% diameter) is designated as the volume-based median diameter.

[Average Circularity of Toner]

Further, as to the toner obtained by a manufacturing method as described above, each toner particle constituting the toner preferably has an average circularity of 0.930-1.000, and more preferably has an average circularity of 0.950-0.995 in view of stability in electrification and low-temperature fixability. When the average circularity is within the above-described range, it becomes difficult to pulverize toner particles, whereby contamination of a frictional electrification-providing member is suppressed to stabilize electrification of the tone; fixability is improved since fillinf density of toner particles in the toner layer having been transferred onto a recording material; and the fixing offset is difficult to be generated.

The average circularity of toner particles is referred to as a value measured by "FPIA-2100" (manufactured by Sysmex Corp.). Specifically, the toner is wetted with an aqueous solution containing a surfactant, followed by being dispersed via an ultrasonic dispersion treatment for one minute, and thereafter the dispersion of toner particles is photographed with "FPIA-2100" (manufactured by Sysmex Corp.) in an HPF (high magnification photographing) mode at an appropriate density of the HPF detection number of 3,000-10,000 as a measurement condition. The circularity of each toner particle is calculated according to Equation (y) described below. Then, the average circularity is calculated by summing the circularities of each of the toner particles and dividing the resulting value by the total number of the toner particles. The HPF detection number falling within the above-described range makes it possible to realize reproducibility.

Circularity=(circumference length of a circle having an area equivalent to a projection of a particle)/(circumference length of a projection of a particle) Equation (y):

[Glass Transition Point and Softening Point of Toner]

The toner of the present invention preferably has a glass transition point Tg of 30-60° C., and more preferably has a glass transition point Tg of 40-55° C. Further, the toner preferably has a softening point of 70-140° C., and more preferably has a softening point of 80-110° C. Herein, glass transition point Tg and softening point were measured by the same method as previously described, except that toner was used as a measuring sample.

Further, the toner of the present invention preferably has a 10% deformation strength of 9-50 MPa as a mechanical strength. This 10% deformation strength is a value measured in compression test mode employing a micro compression tester "MCT-W201" (manufactured by Shimadzu Corporation).

[Developer]

The toner as described above is suitably usable in any of the following exemplified cases. For example, the case where the toner is used as a single-component magnetic toner by containing a magnetic material; the case where the toner is used as a so-called two-component developer by mixing with a carrier; and the case where a non-magnetic toner is used singly.

As a carrier constituting a two-component developer, usable are magnetic particles each made of a commonly known material, for example, metals such as iron, ferrite, magnetite or the like, or an alloy of the above-described metal with a metal such as aluminum, lead or the like. Specifically ferrite particles are preferably used. The volume average particle diameter of the carrier is preferably 15-100 μm, and more preferably 25-60 μm. It is possible to determine the volume average particle diameter of the carrier, employing a laser diffraction system particle size distribution meter "HELOS" (produced by Sympatec Co.) equipped with a wet type homogenizer as an typical measuring device. As the carrier, there is preferably used a carrier further coated with a resin or a so-called resin dispersion type carrier prepared by dispersing magnetic particles in a resin. A resin composition for coating is not specifically limited, but usable examples thereof include an olefin based resin, a styrene based resin, a styrene-acrylic resin, a silicone based resin, an ester based resin, a fluorine-containing polymer based resin and so forth. A resin constituting the resin dispersion type carrier is not specifically limited, and any of those commonly known is usable, Examples thereof include a styrene-acrylic resin, a polyester resin, a fluorine based resin, a phenol based resin and so forth.

[Image Forming Method]

The toner as described above is suitably usable for an image forming method possessing a fixing step carried out by a contact heating method. In the image forming method, specifically, employing the above-described toner, an electrostatic latent image, for example, electrostatically formed on an image carrier is visualized by charging a developer with a frictional electrification member in a developing device to obtain a toner image; this toner image is transferred onto a recording material; and a visualized image is subsequently obtained by fixing the toner image having been transferred onto the recording material via a contact heating system fixing treatment.

Embodiments of the present invention have been specifically explained so far, but they are not limited to the above-described examples, and various changes can be made.

EXAMPLE

Next, specific examples of the present invention will be described, but the present invention is not limited thereto. In addition, the following molecular weight, melting point, glass transition point and softening point were measured as previously described.

<Preparation of Crystalline Polyester Resin Particle Dispersion [A]>

After 312.5 parts by weight of 1,8-sebacic acid as an aliphatic carboxylic acid, 187.5 parts by weight of 1,6-hexanediol as aliphatic diol and 2.0 parts by weight of tetrabutoxy titanium as a catalyst were charged in a heat-dried three-mouth flask, and air in a vessel was evacuated via depressurizing operation, a reflux treatment was conducted at 180° C. for 5 hours while mechanically stirring in the inert atmosphere obtained by introducing nitrogen gas into the vessel. Subsequently, temperature was gradually increased in the inert atmosphere, and stirring was conducted at 200° C. for 3 hours to obtain a product in the form of viscous liquid. Further, depressurization was released at a time when weight average molecular weight (Mw) reached 15,000 while cooling in the air, and measuring this product via GPC to terminate polycondensation, whereby a crystalline polyester resin was synthesized. The resulting crystalline polyester resin had a melting point of 88° C.

Methylethyl ketone and isopropyl alcohol were added in a reaction vessel equipped with an anchor blade by which stirring power is provided, and subsequently, those obtained by coarsely pulverizing the resulting crystalline polyester resin with a hammer mill were gradually added therein while stirring to obtain a polyester resin solution which becomes an oil-phase by completely dissolving the resulting. Next, after an aqueous diluted ammonia solution was slightly dropped in the oil-phase which was agitated, and this oil-phase was further dropped in deionized water to conduct phase-transfer emulsification, a solvent was removed therefrom via depressurization with an evaporator. Crystalline polyester resin particles were produced in a reaction system, and deionized water was added into this dispersion to adjust a solid content to 20% by weight, whereby crystalline polyester resin particle dispersion [A] was prepared. When a volume-based median diameter of crystalline polyester resin particles in the resulting crystalline polyester resin particle dispersion [A] was measured employing an electrophoretic light scattering photometer ELS-800 (manufactured by Otsuka Electronics Co., Ltd.), a volume-based median diameter of 185 nm was obtained.

<Preparation of Unsaturated Amorphous Polyester Resin Particle Dispersion [B]>

After 7.3 parts by weight of a fumaric acid, 125 parts by weight of a terephthalic acid, 18 parts of an isophthalic acid and 2.3 parts by weight of a 5-sulfoisophthalic acid as polycarboxylic acid components, and 264 parts by weight of a 2,2-bis(4-hydroxyphenyl)propane propylene oxide 2 mol adduct (a molecular weight of 460) and 83.4 parts by weight of a 2,2-bis(4-hydroxyphenyl)propane ethylene oxide 2 mol adduct (a molecular weight of 404) as polyhydric alcohol components were charged in a reaction vessel fitted with a stirring device, a nitrogen introducing device, a temperature sensor and a rectifier; an amount of $Ti(OBu)_4$ was charged as a catalyst; temperature in the reaction system was raised to 190° C., spending one hour; and it was confirmed that the inside of the reaction system was evenly stirred, temperature in the reaction system was further raised to 240° C. from the same temperature as described before, spending 6 hours, and further, dehydration condensation reaction was continuously conducted for 6 hours while maintaining the temperature at 240° C. to conduct polymerization reaction, whereby an unsaturated amorphous polyester resin was obtained. The resulting unsaturated amorphous polyester resin had a number average molecular weight Mn of 3,100, a glass transition point Tg of 63° C., and a softening point of 88° C.

The same operation as in preparation of a crystalline polyester resin particle dispersion was conducted for the resulting unsaturated amorphous polyester resin to prepare unsaturated amorphous polyester resin particle dispersion [B] obtained by dispersing unsaturated amorphous polyester resin particles having a solid content of 20% by weight. When a volume-based median diameter of unsaturated amorphous polyester resin particles in the resulting unsaturated amorphous polyester resin particle dispersion [B] was measured employing an electrophoretic light scattering photometer ELS-800 (manufactured by Otsuka Electronics Co., Ltd.), a volume-based median diameter of 218 nm was obtained.

<Preparation of Black Colorant Particle Dispersion [C]>

After 8 parts by weight of sodium n-dodecyl benzene sulfonate were mixed and dissolved in 250 parts by weight of deionized water; 10 parts by weight of carbon black "Regal 330" (produced by Cabot Corp.) and 40 parts by weight of C. I. Pigment Blue 15:3 were charged; and the system was dispersed for 10 minutes by a homogenizer "ULTRA TURRAX T50" (manufactured by IKA Werke GmbH), a dispersing treatment was conducted for 20 minutes employing an ultrasonic homogenizer to obtain a black colorant particle dispersion. Deionized water was further added into the resulting dispersion, and a solid content was adjusted to 20% by weight to prepare black colorant particle dispersion [C]. When a volume-based median diameter of black colorant particles in the resulting black colorant particle dispersion [C] was measured employing an electrophoretic light scattering photometer ELS-800 (manufactured by Otsuka Electronics Co., Ltd.), a volume-based median diameter of 215 nm was obtained.

<Preparation of Releasing Agent Particle Dispersion [D]>

After 5 parts by weight of an anionic surfactant "NEOGEN RK" (produced by DAT-ICHI KOGYO SEIYAKU CO., LTD) and 60 parts by weight of citric acid tribehenate wax (a melting point of 83.2° C.) were charged in 240 parts by weight of deionized water, and heated to 95° C., followed by sufficiently dispersing the resulting with "ULTRA TURRAX T50" (manufactured by IKA Werke GmbH), a dispersing treatment was conducted employing a pressure-ejection type Gaulin homogenizer to obtain a releasing agent particle dispersion. Deionized water was further added into the resulting dispersion, and a solid content was adjusted to 20% by weight to prepare releasing agent particle dispersion [D]. When a volume-based median diameter of releasing agent particles in the resulting releasing agent particle dispersion [D] was measured employing an electrophoretic light scattering photometer ELS-800 (manufactured by Otsuka Electronics Co., Ltd.), a volume-based median diameter of 240 nm was obtained.

Example 1

Toner Preparation Example 1

<Step of Coagulation>

In a homogenizer "ULTRA TURRAX T50" (manufactured by IKA Werke GmbH), charged were 250 parts by weight of the above-described crystalline polyester resin particle dispersion [A], 500 parts by weight of the above-described unsaturated amorphous polyester resin particle dispersion [B], 80 parts by weight of the above-described black colorant particle dispersion [C], 70 parts by weight of the above-described releasing agent particle dispersion [D] and 500 parts by weight of deionized water, followed by mixing for 15 minutes while maintaining temperature at 20° C. Next, 0.1 parts by weight of aluminum polychloride were added therein as a coagulant, and the system was continuously mixed and dispersed for 2 hours while appropriately dropping 0.3 mol/L of an aqueous nitric acid solution or 1 mol/L of an aqueous sodium hydroxide solution, so as to maintain pH at 4.1-4.3. The median diameter in volume average inside the reaction system was measured by a Coulter Multisizer (manufactured by Beckman Coulter, Inc.), and it was confirmed that core coagulated particles had a volume-based median diameter of 3.2 μm.

<Step of Adhesion>

The reaction system in which the core coagulated particles were formed was transferred to a round shape stainless flask; 100 parts by weight of unsaturated amorphous polyester resin particle dispersion [B] were added therein, followed by stirring for 60 minutes; and the unsaturated amorphous polyester resin particle was further attached onto the surface of the core coagulated particle to form core-shell type coagulated particles.

<Step of Coagulation-Termination>

Subsequently, 2.5 parts by weight of an ethylenediamine tetraacetic acid were added; 1 mmol/L of sodium hydroxide was dropped so as to maintain pH at 8-8.5; the unsaturated amorphous polyester resin particle was further attached onto the surface of the core coagulated particle; and coagulation of particles to each other present in the reaction system was terminated to obtain core-shell type coagulated particles having a desired composition. When each of the median diameters in volume average of core-shell type coagulated particles not only immediately after completing this step of coagulation-termination, but also one hour after completing this step of coagulation-termination was measured employing a Coulter Multisizer (manufactured by Beckman Coulter, Inc.), the median diameters were 6.61 μm and 6.59 μm, respectively, and no large increase of the particle diameter was observed.

<Step of Fusion>

When the reaction system in which core-shell type coagulated particles obtained in the step of coagulation-termination were formed was heated to 80° C., followed by stirring for 120 minutes, uncrosslinked toner particles were obtained by fusing polyester resin particles inside core-shell type coagulated particles.

<Step of Crosslinkage>

In the reaction system in which uncrosslinked toner particles obtained in the step of fusion were formed, added were 10.5 parts by weight of potassium persulface, and radical polymerization reaction was conducted while further, continuously stirring at a temperature of 80° C. for 120 minutes to obtain toner particles each having a crosslinking structure.

<Step of Filtration•Washing to Step of Drying>

Thereafter, after cooling the reaction system to 25° C. employing a shell and tube heat exchange, filtration was conducted with filtration paper "No. 5" (produced by Toyo Roshi Kaisha, Ltd.) employing a Nutsche system suction-filtration machine, filtration and washing were repeated until a pH and electrical conductivity of a filtrate reached not more than 6.5 and 12 μm/cm, respectively, followed by drying for 12 hours via vacuum-drying to obtain toner particle [1X]. The resulting toner particle [1X] had a volume-based median diameter of 6.51 μm and a CV value of 16%. Further, as to a reaction residue on the used filter paper, when a ratio of a reaction residue amount to a production amount of toner particles was calculated from the charging amount, the ratio was 4% by weight.

<Step of Adding External Additives>

With respect to 100 parts by weight of the resulting toner particle [1X], added were 2.5 parts by weight of cerium oxide particles (a volume average particle diameter of 0.55 μm), 0.8 parts by weight of titanic particles (having been subjected to a dodecyltrimethoxy silane treatment; a volume average particle diameter of 30 nm), and 1.2 parts by weight of silica particles (having been subjected to a hexamethyldisilazane treatment; a volume average particle diameter of 100 nm); a mixing treatment was conducted by a 5 L Henschel mixer (Mitsui Miike Kakouki. Co., Ltd.) for 10 minutes while streaming with cooling water so as to maintain temperature in the apparatus at 45° C.; and coarse particles were removed from the resulting mixture by a wind power sieving machine "HI-BOLTA NR300" (manufactured by Shin Tokyo Kikai Corporation) having an opening size of 45 μm to prepare toner [1] having been subjected to an external additive treatment.

Example 2

Toner Preparation Example 2

Toner [2] was prepared similarly to preparation in toner preparation example 1, except that the step of fusion and the step of crosslinkage in toner preparation example 1 were conducted in reverse order as described below.

<Step of Crosslinkage>

In the reaction system in which core-shell type coagulated particles obtained in the step of coagulation-termination were formed, added therein were 10.5 parts by weight of potassium persulfate, followed by further, continuously stirring at a temperature of 50° C. for 240 minutes to conduct radical polymerization reaction, whereby core-shell type toner particles each having a crosslinking structure were obtained.

<Step of Fusion>

When the reaction system in which core-shell type toner particles each having a crosslinking structure, obtained in the step of coagulation-termination were formed was heated to 80° C., followed by stirring for 120 minutes, uncrosslinked toner particles were obtained by fusing polyester resin particles inside core-shell type coagulated particles.

Toner particles of the resulting toner [2] had a volume-based median diameter of 6.58 μm and a CV value of 17%. Further, as to a reaction residue on the used filter paper, when a ratio of a reaction residue amount to a production amount of toner particles was calculated from the charging amount, the ratio was 6% by weight.

Example 3

Toner Preparation Example 3

Toner [3] was prepared similarly to preparation in toner preparation example 1, except that the step of crosslinkage and the step of fusion in toner preparation example 1 were conducted at the same time as described below.

<Step of Crosslinkage and Step of Fusion>

Emulsified liquid formed from core-shell type coagulated particles obtained in the step of coagulation-termination was heated to 80° C., and 10.5 parts by weight of potassium persulfate were added therein, followed by continuously stirring for 150 minutes to conduct radical polymerization reaction, whereby toner particles each having a crosslinking structure were obtained.

Toner particles of the resulting toner [3] had a volume-based median diameter of 6.32 μm and a CV value of 14%. Further, as to a reaction residue on the used filter paper, when a ratio of a reaction residue amount to a production amount of toner particles was calculated from the charging amount, the ratio was 3% by weight

Comparative Example 1

Toner Preparation Example 4

<Step of Coagulation>

In a homogenizer "ULTRA TURRAX T50" (manufactured by IKA Werke GmbH), charged were 250 parts by weight of the above-described crystalline polyester resin particle dispersion [A], 500 parts by weight of the above-described unsaturated amorphous polyester resin particle dispersion [B], 80 parts by weight of the above-described black colorant particle dispersion [C], 70 parts by weight of the above-described releasing agent particle dispersion [D] and 500 parts by weight of deionized water, followed by mixing for 15 minutes while maintaining temperature at 20° C. Next, 0.1 parts by weight of aluminum polychloride were added therein as a coagulant, and the system was continuously mixed and dispersed for 2 hours while appropriately dropping 0.3 mol/L of an aqueous nitric acid solution or 1 mol/L of an aqueous sodium hydroxide solution, so as to maintain pH at 4.1-4.3. The median diameter in volume average inside the reaction system was measured by a Coulter Multisizer (manufactured by Beckman Coulter, Inc.), and it was confirmed that core coagulated particles had a volume-based median diameter of 3.2 μm.

<Step of Adhesion and Step of Crosslinkage>

The reaction system in which the core coagulated particles were formed was transferred to a round shape stainless flask; 100 parts by weight of unsaturated amorphous polyester resin particle dispersion [B] and 10.5 parts by weight of potassium persulfate were added therein, followed by stirring for 60 minutes while heating to 65° C. employing an oil bath; and radical polymerization reaction was conducted while further attaching the unsaturated amorphous polyester resin particle onto the surface of the core coagulated particle to form core-shell type coagulated particles. When each of the median diameters in volume average of core-shell type coagulated particles immediately after completing these steps of adhesion and crosslinkage, and one hour after completing these steps of adhesion and crosslinkage was measured employing a Coulter Multisizer (manufactured by Beckman Coulter, Inc.), increase of the median diameter from 7.681 μm to 8.14 μm was confirmed, and increase of the CV value from 23% to 28% was also confirmed, whereby it was confirmed that it was difficult to acquire manufacturing stability.

<Step of Coagulation-Termination>

In the reaction system experienced through the step of adhesion and the step of crosslinkage, added were 2.5 parts by weight of an ethylenediamine tetraacetic acid; 1 mol/L of sodium hydroxide was dropped therein so as to maintain pH at 8-8.5; the unsaturated amorphous polyester resin particle was further attached onto the surface of the core coagulated particle; and coagulation of particles to each other present in the reaction system was terminated. When each of the median diameters in volume average of core-shell type coagulated particles in which a crosslinking structure was formed not only immediately after completing this step of coagulation-termination, but also one hour after completing this step of coagulation-termination was measured employing a Coulter Multisizer (manufactured by Beckman Coulter, Inc.), the median diameters were 7.79 μm and 7.82 μm, respectively, and the CV values were 27% and 28%, respectively, whereby no large increase of the particle diameter was observed.

<Step of Fusion>

When the reaction system in which core-shell type coagulated particles having a crosslinking structure, obtained in the step of coagulation-termination, were formed was heated to 80° C., followed by stirring for 120 minutes, toner particles having a crosslinking structure were obtained by fusing polyester resin particles inside crosslinked core-shell type coagulated particles.

<Step of Filtration•Washing to Step of Drying>

Thereafter, after cooling the reaction system to 25° C. employing a shell and tube heat exchange, filtration was conducted with filtration paper "No. 5" (produced by Toyo Roshi Kaisha, Ltd.) employing a Nutsche system suction-filtration machine, filtration and washing were repeated until a pH and electrical conductivity of a filtrate reached not more than 6.5 and 12 μm/cm, respectively, followed by drying for 12 hours via vacuum-drying to obtain toner particle [4X]. The resulting toner particle [4X] had a volume-based median diameter of 7.78 μm and a CV value of 27%. Further, as to a reaction residue on the used filter paper, when a ratio of a reaction residue amount to a production amount of toner particles was calculated from the charging amount, the ratio was 40% by weight.

<Step of Adding External Additives>

With respect to 100 parts by weight of the resulting toner particle [4X], added were 2.5 parts by weight of cerium oxide particles (a volume average particle diameter of 0.55 μm), 0.8 parts by weight of titania particles (having been subjected to a dodecyltrimethoxy silane treatment; a volume average particle diameter of 30 nm), and 1.2 parts by weight of silica particles (having been subjected to a hexamethyldisilazane treatment; a volume average particle diameter of 100 nm); a mixing treatment was conducted by a 5 L Henschel mixer (Mitsui Miike Kakouki Co., Ltd.) for 10 minutes while streaming with cooling water so as to maintain temperature in the apparatus at 45° C.; and coarse particles were removed from the resulting mixture by a wind power sieving machine "HI-BOLTA NR300" (manufactured by Shin Tokyo Kikai Corporation) having an opening size of 45 μm to prepare toner [4] having been subjected to an external additive treatment.

[Evaluation 1: Evaluation of Heat-Resistant Storage]

For each of the above-described toner [1], toner [2], toner [3] and toner [4], 0.5 g of toner were charged in a 10 mL vial having an inner diameter of 21 mm, and after closing the lid of it, each vial was then shaken 600 times with a tap densor, "KYT-2000" (produced by Seishin Kigyo Co., Ltd.) and after removing the lid of it, the vial was left standing for two hours at 57° C. and 35% RH. Next, the toner was placed on a sieve of 48 mesh (an opening of 350 μm) so as no to damage the toner and was set on a powder tester (produced by Hosokawa Micron Co. Ltd.), while securing it with a pressure bar and a knob nut, and the powder tester was adjusted to a vibration intensity of a feeding width of 1 mm to apply vibration thereto for 10 seconds. Thereafter, the amount of toner remaining on the sieve was measured, and a toner aggregation ratio was calculated by the following equation to be evaluated in accordance with the following evaluation criteria. Results are shown in Table 1.

$$\text{Toner aggregation ratio(\% by weight)}=\{\text{Residual amount of toner (g)}/0.5\text{ (g)}\}\times 100 \qquad \text{Equation (1):}$$

—Evaluation Criteria—

A: A toner aggregation ratio of less than 15% by weight (Excellent)

B: A toner aggregation ratio of 15-20% by weight (Good)

C: A toner aggregation ratio exceeding 20% (No Good)

[Evaluation 2: Evaluation of Fixing Offset]

As to prepared toner [1], toner [2], toner [3] and toner [4], a silicone resin-coated ferrite carrier having a volume-based medium diameter of 60 μm was mixed so as to make concentration of the foregoing toner to be 6% by weight to prepare developer [1], developer [2], developer [3] and developer [4]. As to developer [1], developer [2], developer [3] and developer [4], after a machine obtained by modifying a full-color copier "bizhub PRO C6501" (manufactured by Konica Minolta Business Technologies, Inc.) as a commercially available printer was employed in such a way that the surface temperature of a heat roller for fixing was possible to be varied in the range of 100-210° C., and an A4 (a basis weight of 80 g/m$^2$) plain paper sheet was longitudinally conveyed to fix a solid belt-shaped image having a width of 5 mm, which expands in the direction perpendicular to the conveyance direction, a fixing experiment by which a solid belt-shaped image having a width of 5 mm and a halftone image having a width of 20 mm, which expand in the direction perpendicular to the conveyance direction were fixed was repeatedly conducted while varying the fixing temperature to be set at 5° C. intervals in the increasing manner such as 100° C., 105° C. and so forth. The fixing temperature in the fixing experiment in which the stained images caused by low-temperature offset and high-temperature offset, respectively, were observed was measured as each of low-temperature offset temperature and high-temperature offset temperature. Results are shown in Table 1.

[Evaluation 3: Evaluation of Lower Limit Fixing Temperature]

As to developer [1], developer [2], developer [3] and developer [4], after a machine obtained by modifying a full-color copier "bizhub PRO C6501" (manufactured by Konica Minolta Business Technologies, Inc.) as a commercially available printer was employed in such a way that the surface temperature of a heat roller for fixing was possible to be varied in the range of 100-210° C., the fixing experiment in which a solid image of a toner coating amount of 11 mg/cm$^2$ was fixed on an A4 (a basis weight of 80 g/m$^2$) plain paper sheet was repeatedly conducted while varying the fixing temperature to be set at 5° C. intervals in the increasing manner from 100° C. The printed matter obtained in the fixing experiment at each fixing temperature was folded while applying a load to the solid image with a folding machine, followed by spraying compressed air at 0.35 MPa onto this. Referring to a limit sample, the fold was ranked to 5 levels shown in the following evaluation criteria, and the fixing temperature in the fixing experiment at rank 3 was set to the lower limit fixing temperature. Results are shown in Table 1.

—Evaluation Criteria—

Rank 5: No fold was observed.

Rank 4: Peeling along the fold was partially observed.

Rank 3: Fine line-shaped peeling along the fold was observed.

Rank 2: Thick line-shaped peeling along the fold was observed.

Rank 1: Peeling was largely observed.

[Evaluation 4: Evaluation of Density Gradation]

As to developer [1], developer [2], developer [3] and developer [4], a machine obtained by modifying a full-color copier "bizhub PRO C6501" (manufactured by Konica Minolta Business Technologies, Inc.) as a commercially available printer was employed in such a way that the surface temperature of a heat roller for fixing was possible to be varied in the range of 100-210° C.; square dot tint images through a solid image (100% image), 30%, 50% and 70% each with a toner coating amount of 10 mg/cm$^2$ were formed on a coated paper sheet having a thickness of 250 g/m$^2$; and GI values of the tint images were measured employing a system of analyzing 4 images "GI-es-S500AAC" (NATIONAL INSTRUMENTS CORP.) in the situation where the above-described heat roller for fixing was set to higher temperature of the above-described low-temperature offset temperature and the lower limit fixing temperature (minimum fixing temperature). Results are shown below. In addition, when the GI value is less than 0.25, rough feeling of images is reduced, and it has been confirmed to be practically durable.

[Evaluation 5: Gloss Level]

As to developer [1], developer [2], developer [3] and developer [4], a machine obtained by modifying a full-color copier "bizhub PRO C6501" (manufactured by Konica Minolta Business Technologies, Inc.) as a commercially available printer was employed in such a way that the surface temperature of a heat roller for fixing was possible to be varied in the range of 100-210° C.; and square dot tint images through a solid image (100% image) and of 50% image each with a toner coating amount of 10 mg/cm$^2$ were formed on a coated paper sheet having a thickness of 250 g/m$^2$ to measure 75° gloss of the 100% image as a gloss level employing "Gardner micro-gloss 75°". Results are shown in Table 1. When the gloss level is in the range between 60 and 80, the evaluation was made as "Pass" since there was appropriate gloss together with no glare. When the gloss level exceeds 80, the evaluation was made as "No Good" since there was uncomfortable feeling caused by glare. When the gloss level is less than 60, the evaluation was made as "Fail".

TABLE 1

| | | Preparation results | | Evaluation results | | | | | |
|---|---|---|---|---|---|---|---|---|---|
| | Toner No. | Reaction residue amount | CV value | Heat-resistant storage | Low-temp. offset temp. | High-temp. offset temp. | Lower limit fixing temp. | Gloss level | Density Gradation (GI value) |
| Ex. 1 | 1 | 4% by weight | 16% | B | 130° C. | No generation | 138° C. | Pass | 0.22 |
| Ex. 2 | 2 | 6% by weight | 17% | B | 135° C. | No generation | 135° C. | Pass | 0.22 |
| Ex. 3 | 3 | 3% by weight | 14% | A | 125° C. | No generation | 130° C. | Pass | 0.21 |
| Comp. 1 | 4 | 40% by weight | 27% | C | 150° C. | 175° C. | 160° C. | Fail | 0.35 |

Ex.: Example

Comp.: Comparative example temp.: temperature

EFFECT OF THE INVENTION

According to a method of manufacturing toner of the present invention, since formation of a crosslinking structure is carried out by a method of manufacturing toner of the present invention after desirably attaching each of particles made of an amorphous polyester resin containing at least a polymerizable unsaturated bond on the surface of each of core coagulated particles in an aqueous medium, a polymerization toner containing a polyester resin having a crosslinking structure can be surely prepared, and the resulting toner as to toner particles having the desired composition and structure becomes one in which high yield is obtained, that is, one having a sharp particle size distribution. As a result, excellent high-temperature offsetting resistance and heat-resistant storage are obtained from a polyester resin having a crosslinking structure formed in a toner particle, together with excellent low-temperature fixability, and appropriate gloss can be provided for the image to be formed. Further, toner with which reproduction in density gradation is obtained can be prepared at reduced energy because of an excellent electrification characteristic produced by a sharp particle size distribution.

As to the reason why toner particles having the desired composition and structure can be obtained at high yield via formation of a crosslinking structure after desirably attaching a particle made of an amorphous polyester resin containing at least a polymerizable unsaturated bond on the surface of a core coagulated particle, it would appear as described below. That is, since formation of an aggregate of particle-to-particle obtained from an amorphous polyester resin containing at least a polymerizable unsaturated bond is to be inhibited during action of a radical polymerization initiator, it would appear that formation of unintended particles such as a crosslinking body of the foregoing aggregate in the aqueous medium via radical polymerization reaction is due to being inhibited.

What is claimed is:

1. A method of manufacturing an electrostatic charge image developing toner comprising a toner particle containing a binder resin comprising an amorphous polyester resin having a crosslinking structure and a crystalline polyester resin, comprising the steps of:

(a-1) preparing an aqueous medium dispersion of crystalline polyester resin particles;

(a-2) preparing another aqueous medium dispersion of amorphous polyester resin particles, the amorphous polyester resin comprising a polymerizable unsaturated bond;

(b) coagulating at least the crystalline polyester resin particles in an aqueous medium to form core coagulated particles;

(c) attaching the amorphous polyester resin particles onto a surface of each of the core coagulated particles to form core-shell type coagulated particles; and (d) subsequently conducting radical polymerization reaction via a radical polymerization initiator on the core-shell type coagulated particles to form a layer made of the amorphous polyester resin having a crosslinking structure on the surface of each of the core coagulated particles.

2. The method of claim 1, further comprising the step of:

(e) adding a coagulation-termination agent between the steps (c) and (d).

3. The method of claim 2, wherein the radical polymerization in the step (d) is conducted at a temperature of not less than 50° C. and not more than a melting point of the crystalline polyester resin.

4. The method of claim 3, wherein the crystalline polyester resin in the toner particle has a content of 20-70% by weight.

5. The method of claim 2, wherein the amorphous polyester resin comprising a polymerizable unsaturated bond has a content of 10-60% by weight, based on a total weight of toner particles.

6. The method of claim 2, wherein the amorphous polyester resin comprising a polymerizable unsaturated bond has a softening point of 80-180° C.

7. The method of claim 2, wherein a part of the amorphous polyester resin is the amorphous polyester resin comprising a polymerizable unsaturated bond.

8. The method of claim 2, wherein the toner has a softening point of 80-110° C.

9. The method of claim 2, wherein all of the amorphous polyester resin is the amorphous polyester resin comprising a polymerizable unsaturated bond.

* * * * *